US005611107A

United States Patent [19]

Tomasiak et al.

[11] Patent Number: 5,611,107

[45] Date of Patent: Mar. 18, 1997

[54] LATCHING MECHANISMS FOR WET/DRY UTILITY VACUUM CLEANER WITH DETACHABLE BLOWER

[75] Inventors: Mark J. Tomasiak, O'Fallon; Jeffrey L. Young, St. Peters; Stuart V. Holsten, O'Fallon, all of Mo.

[73] Assignee: Emerson Electric Co., St. Louis, Mo.

[21] Appl. No.: 627,471

[22] Filed: Apr. 4, 1996

Related U.S. Application Data

[63] Continuation-in-part of Ser. No. 332,591, Oct. 31, 1994.

[51] Int. Cl.[6] ..... A47L 5/36

[52] U.S. Cl. ..... 15/327.2; 15/327.6; 15/329

[58] Field of Search ..... 15/327.1, 327.2, 15/328, 327.6, 329

[56] References Cited

U.S. PATENT DOCUMENTS

| | | | |
|---|---|---|---|
| 3,732,667 | 5/1973 | Fromknecht et al. | 15/327.6 X |
| 4,836,753 | 6/1989 | Berfield et al. | 15/329 X |
| 5,353,470 | 10/1994 | Bartlett | 15/328 |
| 5,388,301 | 2/1995 | Bosyj et al. | 15/327.6 X |
| 5,404,614 | 4/1995 | Stephens | 15/328 X |
| 5,528,794 | 6/1996 | Tomasiak | 15/327.6 X |

FOREIGN PATENT DOCUMENTS

| | | | |
|---|---|---|---|
| 461861 | 12/1949 | Canada | 15/329 |

*Primary Examiner*—Chris K. Moore
*Attorney, Agent, or Firm*—Polster, Lieder, Woodruff & Lucchesi

[57] ABSTRACT

A wet/dry utility vacuum cleaner with detachable blower is disclosed. The detachable blower, when mounted in sealed relationship to a lid positioned above a utility vacuum cleaner drum, operates as a wet/dry utility vacuum cleaner. When separated from the utility vacuum cleaner drum, the detachable blower can be used for non-vacuuming applications. The utility vacuum drum lid includes two resilient and deformable latches: a releasable blower latch and a releasable lid latch. The releasable blower latch detachably mounts the detachable blower to the lid while the releasable lid latch detachably mounts the lid relative to the utility vacuum cleaner drum. The releasable blower latch has at least one reinforcing fin for engaging a complementary slot in the lid. The releasable lid latch has at least one slot for receiving a complementary reinforcing fin on the lid. The seating of the reinforcing fins in the respective slots, when the respective latches are in an engaged position, prevents the deformation of the respective latches and unwanted disattachment from the vacuum cleaner.

23 Claims, 11 Drawing Sheets

LATCHING MECHANISMS FOR WET/DRY UTILITY VACUUM CLEANER WITH DETACHABLE BLOWER

CROSS REFERENCE TO RELATED APPLICATIONS

This application is a continuation-in-part of application Ser. No. 08/332,591, filed Oct. 31, 1994 entitled WET/DRY UTILITY VACUUM CLEANER WITH DETACHABLE BLOWER, which is a related copending application to Ser. No. 08/303,689, filed Sep. 9, 1994 entitled UTILITY VACUUM CLEANER TOOL CADDY AND WHEEL MOUNT, now U.S. Pat. No. 5,528,794 and Ser. No. 08/236,198, filed May 2, 1994 entitled MOTOR DESIGNED FOR MANUFACTURING AND METHOD OF ASSEMBLY, now U.S. Pat. No. 5,487,213, all of which are assigned to the same assignee as the present invention.

BACKGROUND OF THE INVENTION

The present invention relates to a wet/dry utility vacuum cleaner with detachable blower, and more particularly, to latching features for attaching the detachable blower to a lid of a vacuum cleaner drum, as well as latching features for attaching the lid to the vacuum cleaner drum itself.

Wet/dry utility vacuum cleaners with detachable blowers are well known in the art. One typical example is shown in U.S. Pat. No. 4,797,072 in which the detachable blower, when mounted to a utility vacuum cleaner drum, serves to provide a jointly operating wet/dry utility vacuum cleaner drum unit; however, when the detachable blower is separated from the vacuum cleaner drum, the detachable blower can be used for a variety of different blower applications. The wet/dry utility vacuum cleaner with detachable blower of the present invention functions generally in the manner described above; however, it provides improved latching features to facilitate the joint or separate use of the detachable blower relative to the wet/dry utility vacuum cleaner, as well as improved latching features to facilitate attachment of a lid to a vacuum cleaner drum,as will be described in detail below.

SUMMARY OF THE INVENTION

Among the several objects and advantages of the present invention include:

The provision of new and improved latching features for a detachable blower in a wet/dry utility vacuum cleaner;

The provision of new and improved latching features for attaching a lid to a vacuum cleaner drum in a wet/dry utility vacuum cleaner;

The provision of the aforementioned new and improved latching feature in which the detachable blower is attached to the lid by a releasable blower latch;

The provision of the aforementioned new and improved latching features in which the lid is attached to the drum by a releasable lid latch;

The provision of the aforementioned new and improved latching features in which each of the blower latch and lid latch employ a slot and fin arrangement between each latch and lid to prevent each such latch from deforming and disengaging from the utilty vacuum cleaner when each such latch is in an engaged position;

The provision of the aforementioned new and improved blower latch in which the blower latch contains at least one fin for engaging a complementary slot in the lid when the blower latch is in engaged position so as to prevent the blower latch from deforming and disengaging relative the lid;

The provision of the aforementioned new and improved lid latch in which the lid latch has at least one slot for engaging a complementary fin formed on the lid when the lid latch is in an engaged position so as to keep the lid latch from deforming and disengaging relative to the lid;

The provision of the aforementioned new and improved blower latch and lid latch that are well constructed, easy to operate, easy to maintain and clean, strong and durable for long lasting operation and are otherwise well adapted for the purposes intended.

Briefly stated, the wet/dry utility vacuum cleaner with detachable blower includes a vacuum cleaner drum having a bottom wall, a side wall and an enlarged rim surrounding an open upper end of the drum. A lid is releasably mounted to the enlarged rim and extends across the open upper end of the vacuum cleaner drum. A detachable blower is also mounted to the lid for joint or separate operation, as may be desired. A releasable blower latch and a releasable lid latch are provided to facilitate engagement or disengagement relative to the lid. Both the releasable blower latch and releasable lid latch are lateraly deformable for engaging latch supporting structure in the lid. Both the releasable blower latch and releasable lid latch are also provided with structural reinforcing means to restrict deformation when in engaged position relative to the lid.

The releasable blower latch is pivotally mounted to the lid and releasably engages a complementary latch opening in the blower. The blower latch is laterally deformable to allow introduction into blower latch mounting structure. The releasable blower latch includes aligned and spaced pivot posts with an intermediate deformable opening to allow deformation of the pivot posts for reception and mounting into spaced openings provided in spaced supports. The blower latch also includes at least one reinforcing fin disposed to engage a complementary opening in the lid when the blower latch is in engaged position relative to the lid. The positioning of the reinforcing fin in the complementary opening prevents the blower latch from deforming and disengaging from the blower latch mounting structure. The releasable blower latch further includes an upstanding finger engaging portion for moving the releasable blower latch into engagement or disengagement relative to the blower.

The releasable lid latch is pivotally mounted to the lid and includes a releasable locking shoulder for engaging the enlarged rim of the vacuum cleaner drum and a finger gripping section for engaging or disengaging the releasable lid latch to the enlarged rim of the drum. The releasable locking shoulder is resilient and deflectable for camming locking engagement with the enlarged rim. The upper end of the releasable lid latch includes aligned and spaced pivot posts extending laterally outwardly from the releasable lid latch for pivotal mounting to spaced supports in the lid. The upper end of the releasable lid latch includes at least one deformable opening which causes deformation of the releasable lid latch between the aligned and spaced pivot posts to enable the aligned and spaced pivot posts to be moved inwardly prior to being received within complementary shaped mounting openings in the spaced supports. The lid includes at least one reinforcing fin which engages the deformable opening in the releasable lid latch when the releasable lid latch is engaged with the lid. The positioning of the reinforcing fin in the deformable opening prevents the lid latch from deforming and disengaging from the spaced supports.

These and other objects and advantages of the present invention will become more apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENTS

The following detailed description illustrates the invention by way of example and not by way of limitation. The description will clearly enable one skilled in the art to make and use the invention, including what we presently believe is the best mode mode of carrying out the invention.

Figure 2:
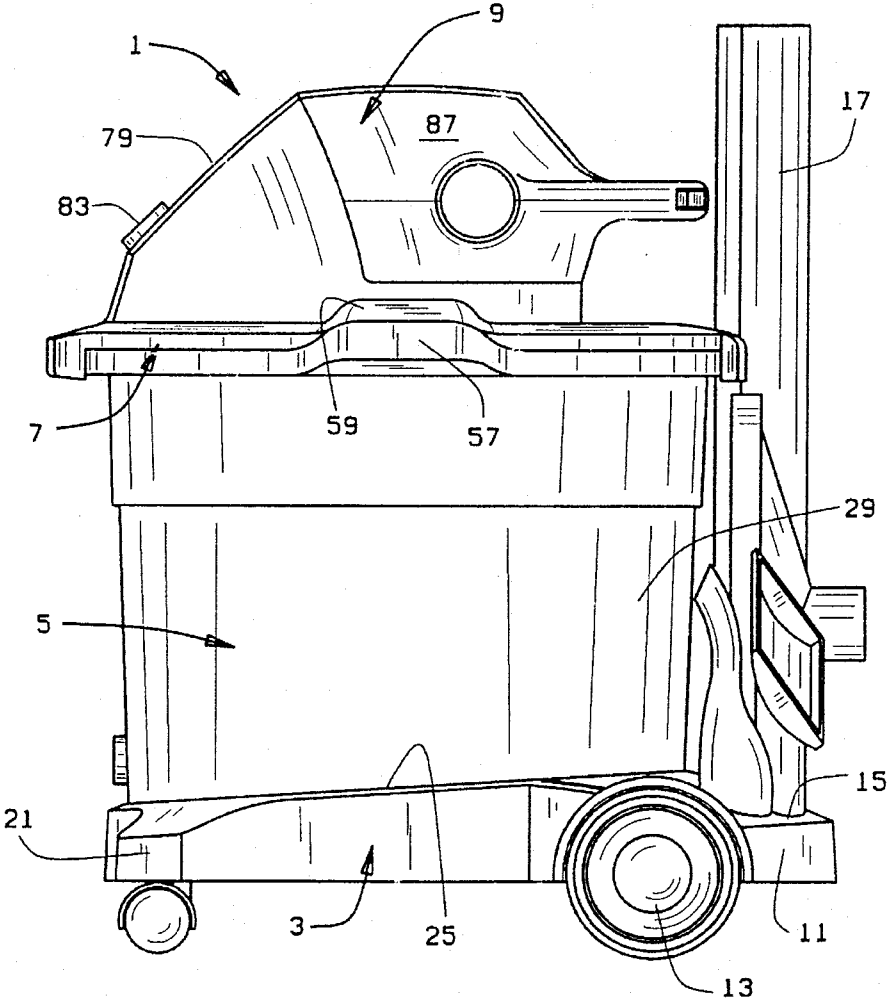
FIG. 2 is a side elevational view of the wet/dry utility vacuum cleaner with detachable blower illustrated in FIG. 1.
Figure 1:
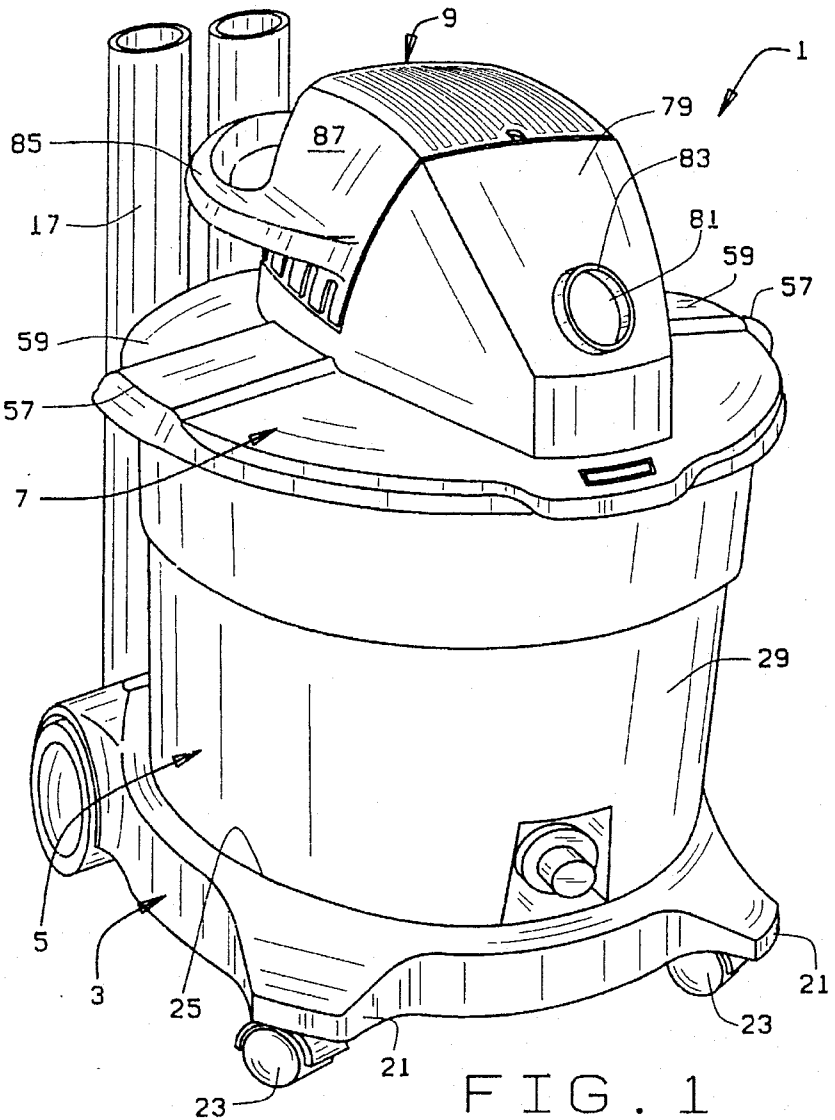
FIG. 1 is a front perspective view of the wet/dry utility vacuum cleaner with detachable blower constructed in accordance with the teachings of the present invention.

The wet/dry utility vacuum cleaner with detachable blower 1 shown in FIGS. 1–2 of the drawings includes a tool caddy 3 which receives a vacuum cleaner drum 5, a lid 7 that covers the open upper end of the vacuum cleaner drum 5 and a detachable blower 9 that is received within complementary shaped cavities or openings of the lid 7. The detachable blower 9 is also capable of being separated from the lid 7 for independent use, as desired.

The tool caddy 3 is constructed as a one-piece molded unit from polypropylene or other similar suitable material. The tool caddy 3 includes a rear bumper 11 for the spaced large terrain wheels 13, 13. In addition, the rear bumper 11 includes a series of spaced tool openings 15 (see FIG. 3) for receiving a series of vacuum tools 17 as illustrated in FIGS. 1–2 of the drawings. The tool caddy 3 further includes spaced front bumper sections 21, 21 which are adapted to overlie and protect individual wheel casters 23, 23, as best seen in FIGS. 1–2 of the drawings. The tool caddy 3 incorporates a central depression 25 for receiving the vacuum cleaner drum 5, as illustrated in FIGS. 1–6 of the drawings.

For a further detailed description of the construction and operation of the tool caddy 3 in conjunction with the wet/dry utility vacuum cleaner with detachable blower of the present invention, reference is made to copending patent application Ser. No. 08/303,689, filed Sep. 9, 1994, entitled UTILITY VACUUM CLEANER TOOL CADDY AND WHEEL MOUNT now U.S. Pat. No. 5,528,794 which is assigned to the same assignee as the present invention.

Figure 4:
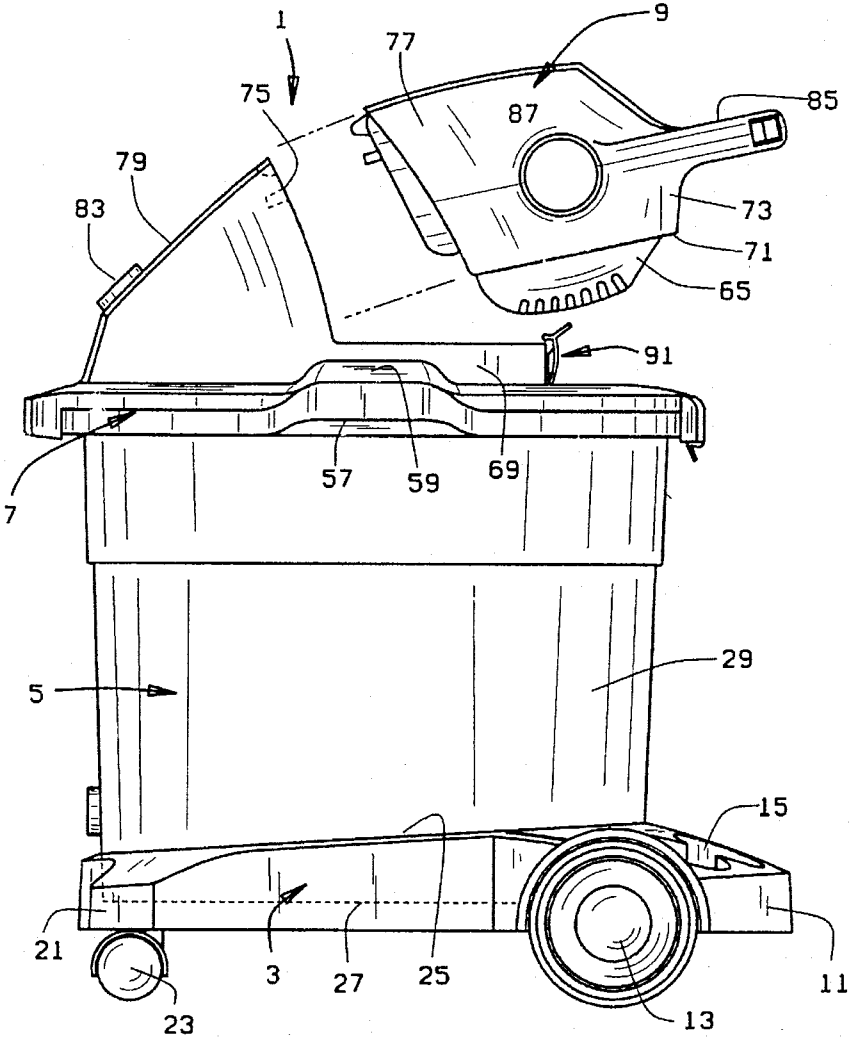
FIG. 4 is an exploded side elevational view of the wet/dry utility vacuum cleaner with the detachable blower removed therefrom.

The vacuum cleaner drum 5 includes a bottom wall 27 shown in dotted lines in FIG. 4 of the drawings which rests on supporting sections within the central depression 25 of the tool caddy. Extending upwardly from the bottom wall is a side wall 29 which terminates in an enlarged rim 31 surrounding an open upper end 33 of the vacuum cleaner drum 5, as shown in FIG. 13 of the drawings. The lid 7 is detachably mounted to an enlarged rim 31 of the vacuum cleaner drum 5 and extends across the open upper end 3 of the vacuum cleaner dram 5. In order to secure the detachable lid 7 to the enlarged rim 31 at the upper end of the vacuum cleaner drum 5, the detachable lid 7 includes a hook portion or pivot element 35 (see FIG. 12) which is adapted to also engage beneath the enlarged rim 31 when the lid 7 is positioned at an angle relative to the enlarged rim 31 to enable a limited range of pivotal movement of the lid 7 relative to the vacuum cleaner dram 5 from the aforementioned angular position to a generally transverse position of the lid when mounted in closed position over the open upper end 33 of the vacuum cleaner drum 5.

The detachable lid 7 includes a detachable or releasable lid latch 37 which is provided in the lid 7 at a location generally opposite the hook shaped pivot element 35. The releasable lid latch 37 is formed independently of the lid 7 and is pivotally mounted to the lid 7 adjacent its open upper end at 39, as best seen in FIG. 13 of the drawings. The lower end of the releasable lid latch 37 includes a finger gripping section 41 to enable a user to grip the finger gripping section 41 for moving the releasable lid latch 37 into and out of engagement relative to the enlarged rim 31 of the vacuum cleaner drum 5. Intermediate the pivotal section 39 at the upper end and the finger gripping section 41 at the lower end of the releasable lid latch 37 is a releasable locking element 43 that is configured, arranged and dimensioned for releasable locking engagement beneath the enlarged rim 31 of the vacuum cleaner drum 5. As best seen in FIG. 13 of the drawings, the releasable locking element 43 includes a combined L-shaped section 45 and a up-side-down U-shaped section 47 which are integrally interconnected to one another and enable the up-side-down U-shaped section 47 to extend sufficiently radially inwardly to form the releasable locking element 43 that underlies the enlarged rim 31 when the releasable lid latch 37 is pivotally moved about the pivot section 39 to an engaged position beneath the enlarged rim 31,as shown in FIG. 13 of the drawings. It will be appreciated that since the releasable lid latch 37 is integrally moled from a flexible plastic material, the releasable locking element 43 is resilient and deflectable for camming locking engagement beneath the enlarged rim 31, as shown in FIG. 13.

Figure 17:
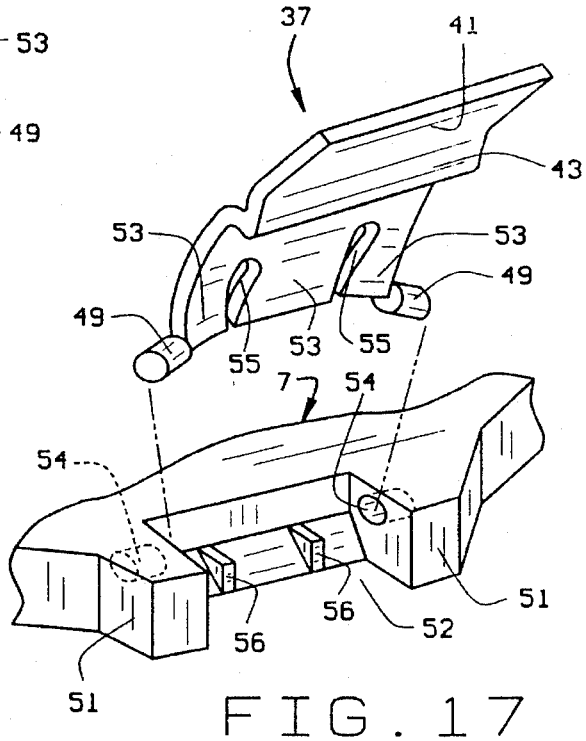
FIG. 17 is a fragmentary perspective view of the lid with the detachable or releasable lid latch being deformed for attachment to the lid.
Figure 18:
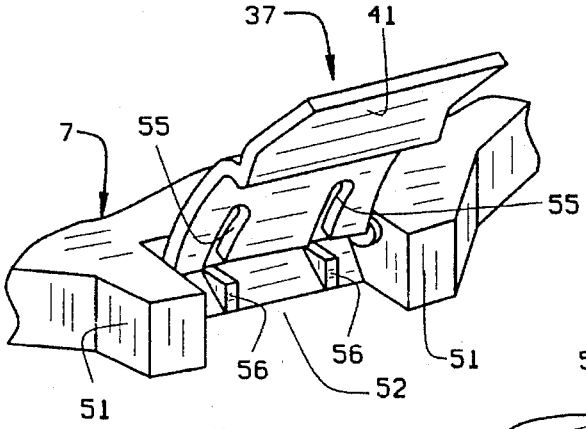
FIG. 18 is a fragmentary perspective view of the assembled lid and detachable or releasable lid latch in an unlatched position.
Figure 19:
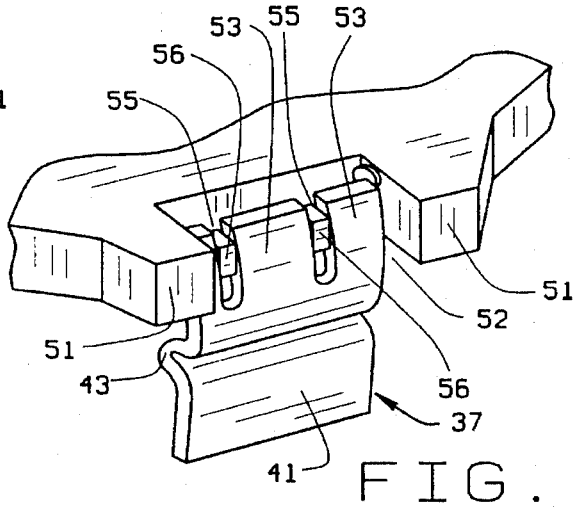
FIG. 19 is a fragmentary perspective view of the assembled lid and detachable or releasable lid latch in latched position.
Figure 20:
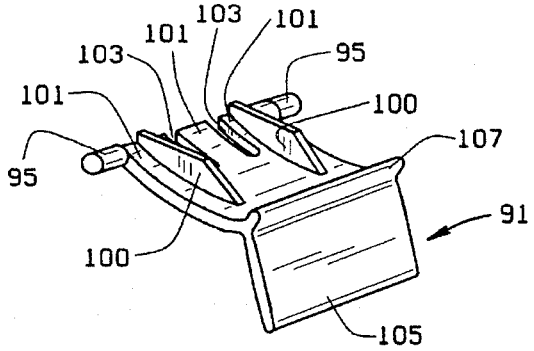
FIG. 20 is a fragmentary perspective view of the releasable blower latch.

The upper pivot 39 includes spaced and aligned posts 49, 49 that extend laterally outwardly from the releasable lid latch 37 for pivotal mounting at 39 to spaced supports 51, 51 of the lid 7, as shown in FIG. 3 and 17–19, for the assembled pivotal mounting of the releasable lid latch 37 to the lid. Between the spaced and aligned pivot posts 49, 49, the releasable lid latch 37, at its upper end, includes a series of aligned and spaced sections 53, 53, 53 separated by openings 55, 55, in order to allow the pivot posts 49, 49 to be resiliently deformed inwardly, relative to the smaller V-shaped opening 52 between the spaced supports 51, 51 as shown in fig. 17, for reception within complementary shaped mounting holes 54, 54 provided in the spaced supports 51, 51. Once the spaced and aligned posts 49, 49 are received within complementary shaped holes 54, 54 of the supports 51, 51 the aligned and spaced sections 53, 53, 53 are returned to their normal condition for securing lid latch 37 in assembled position relative to the spaced supports 51,51 of the lid 7, as shown in FIG. 18. Between the spaced supports 51, 51 are a pair of fins 56, 56. As illustrated in FIGS. 18 and 19, fins 56, 56 are, in the preferred embodiment, generally triangular-shaped, substantially rigid projections that are integrally moled with lid 7 and positioned for reception within complementary shaped openings 55, 55.

As seen in FIG. 18, fins 56, 56 do not interfere with latch 37 when the latch is in its raised or unlatched position. However, when pivot posts 49, 49 are rotated in openings 54, 54 to enable the lid latch 37 to be pivoted down to its latched position as shown in FIG. 19, fins 56, 56 seat in openings 55, 55. It will be appreciated by those skilled in the art that the presence of the fins 56, 56 in the openings 55, 55 prevents latch 37 from deforming, as shown in FIG. 17, and prevents displacement of pivot posts 49, 49 from openings 54, 54. Thus, the fins 56, 56 in the openings 55, 55 serve to strengthen or reinforce the lid latch 37 when in engaged position with the lid 7.

The vacuum cleaner drum 5 also includes spaced and opposed drum lifting handle sections 57, 57, each of which are 90° offset from the hook shaped pivot element 35 and releasable lid latch 37. These drum lifting handle sections 57, 57 are aligned relative to integral strut elements 59, 59 formed in the lid 7 for strengthening the drum lifting handle sections 57, 57 in order to facilitate lifting of the vacuum cleaner drum 5.

Figure 11:
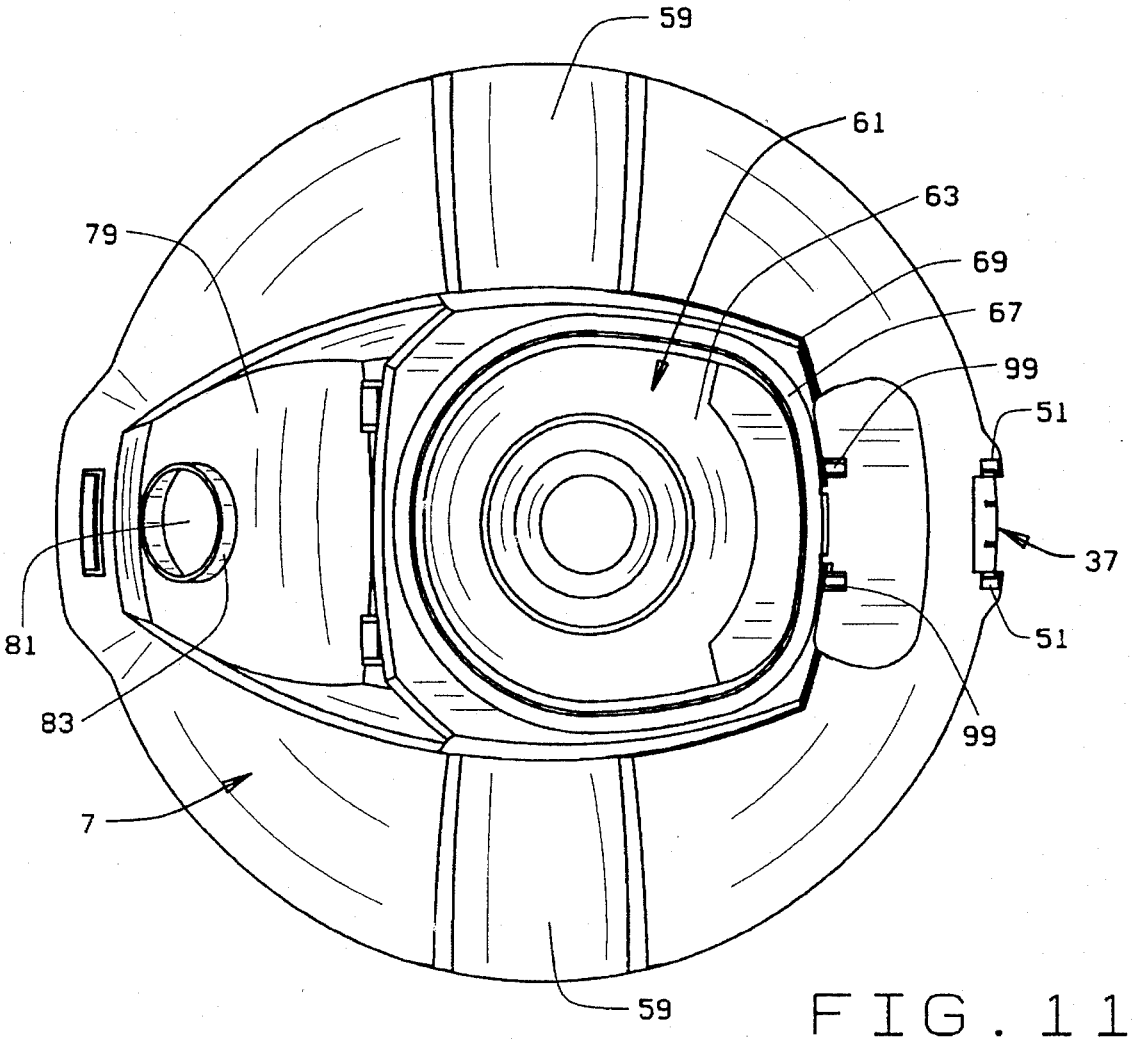
FIG. 11 is a top plan view of the lid including a depression or lid cavity which receives the detachable blower when the detachable blower is mounted to the wet/dry utility vacuum cleaner.
Figure 12:
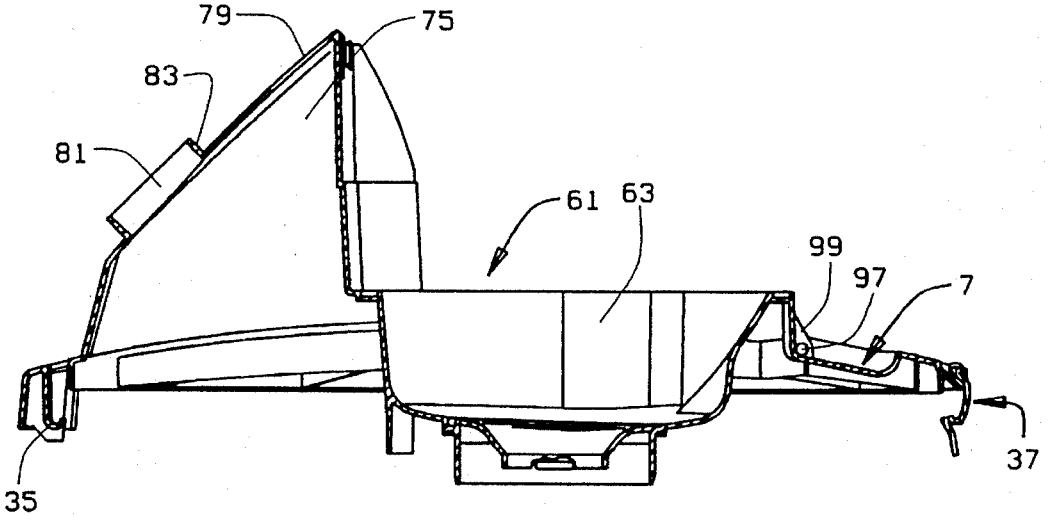
FIG. 12 is a sectional view of the lid including depression or lid cavity illustrated in FIG. 11 of the drawings and also including a detachable releasable lid latch mounted to the lid.
Figure 13:
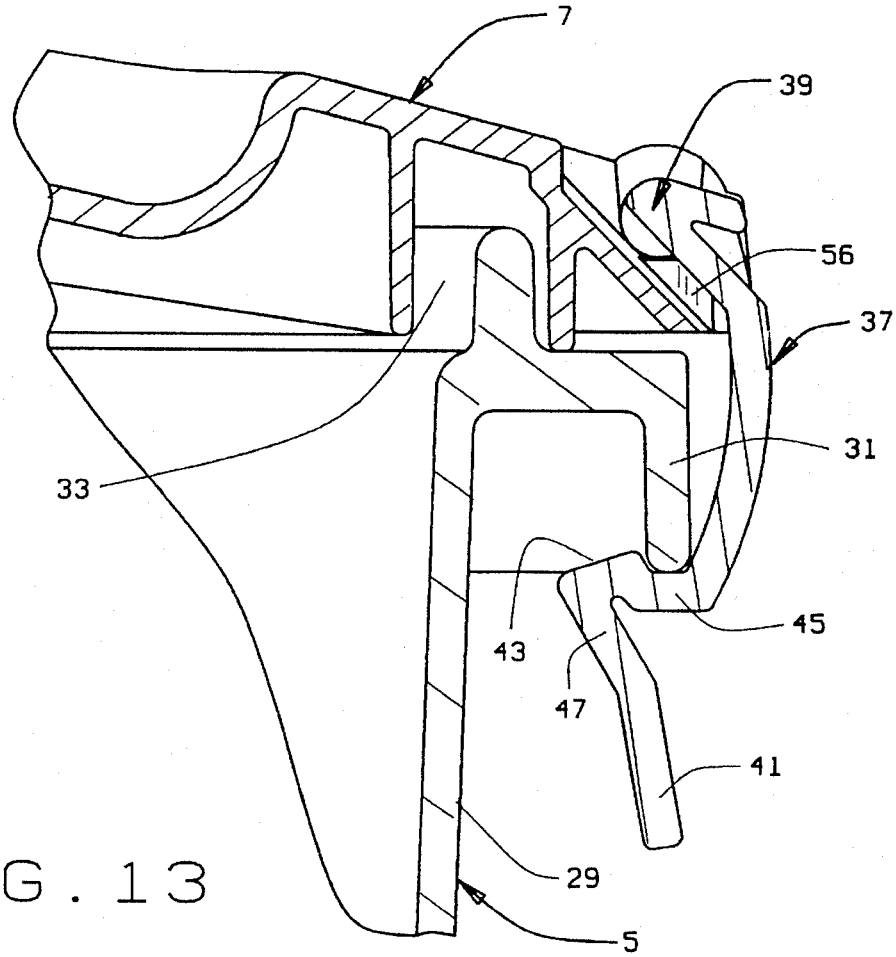
FIG. 13 is an enlarged sectional view of the detachable or releasable lid latch mounted to the lid for engagement with an enlarged rim at the open upper end of the vacuum cleaner drum.
Figure 14:
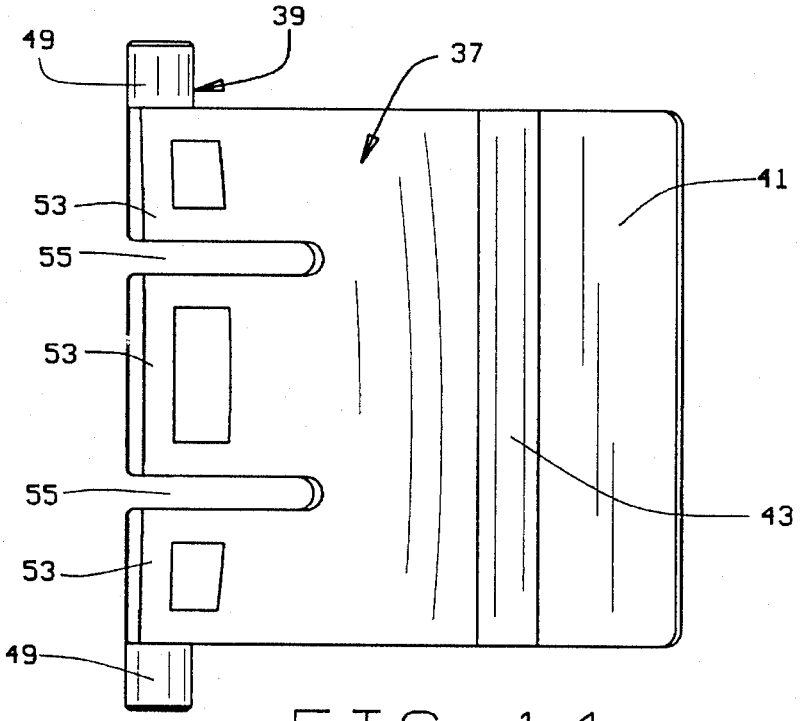
FIG. 14 is a top plan view of the detachable or releasable lid latch.
Figure 15:
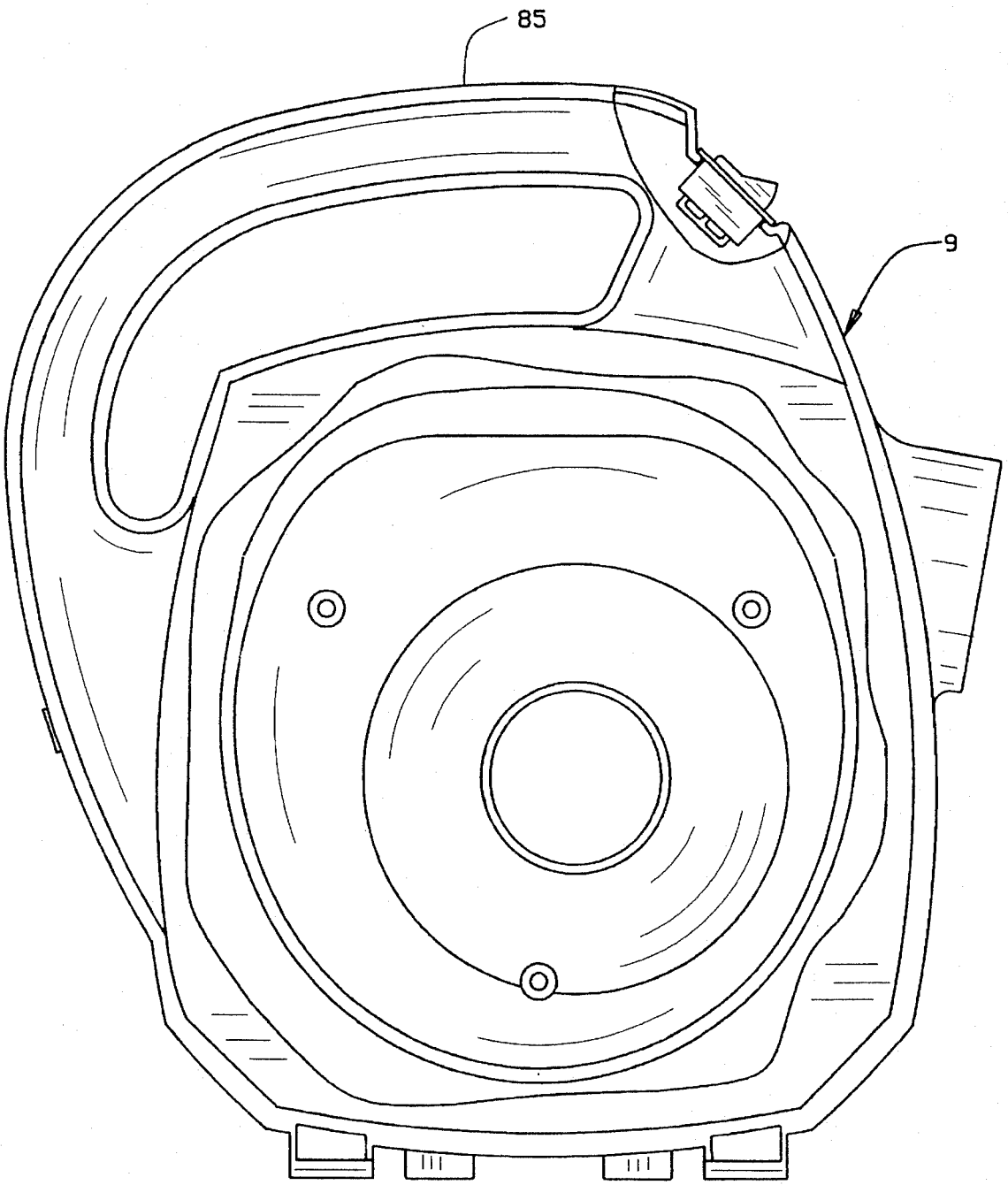
FIG. 15 is an enlarged side elevational view of the detachable blower with one side removed to illustrate the exhaust scroll design for increasing detachable blower efficiency and also showing the relative position of the U-shaped handle relative to the detachable blower.
Figure 16:
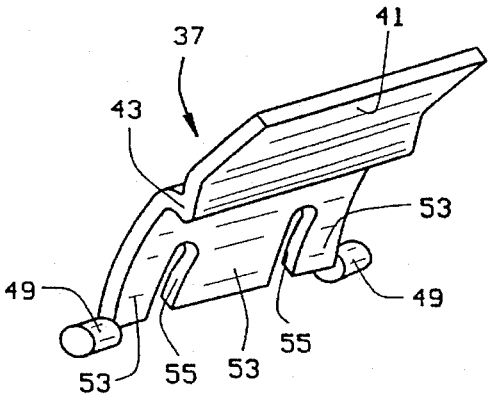
FIG. 16 is a perspective view of the detachable or releasable lid latch.

For receiving the detachable blower 9, the lid 7 includes a wall cavity or depression 61, as best seen in FIGS. 11–12 of the drawings. The wall cavity or depression 61 includes a lower wall cavity 63 that is complementary to a lower portion of the detachable blower 9. Specifically, the lower wall cavity 63 has a complementary shape and configuration to the lower portion 65 of the detachable blower 9, as shown in FIG. 4, in order that the lower portion 65 of the detachable blower 9 can be readily received within the lower wall cavity 63. The lower wall cavity 63 includes an inner supporting wall 67 and an outer wall 69 spaced from the inner wall 67. The inner wall 67 of the lower wall cavity 63 engages the lower circumferential shoulder 71 that is spaced upwardly from the lower portion 65 of the detachable blower 9, in order to support the detachable blower 9 in stable condition, with the outer wall 69 surrounding the lower body portion 73 of the detachable blower, as illustrated by the assembled and disassembled positions of the detachable blower 9 relative to the wet/dry utility vacuum cleaner 1 shown in FIGS. 3–4 of the drawings.

Figure 3:
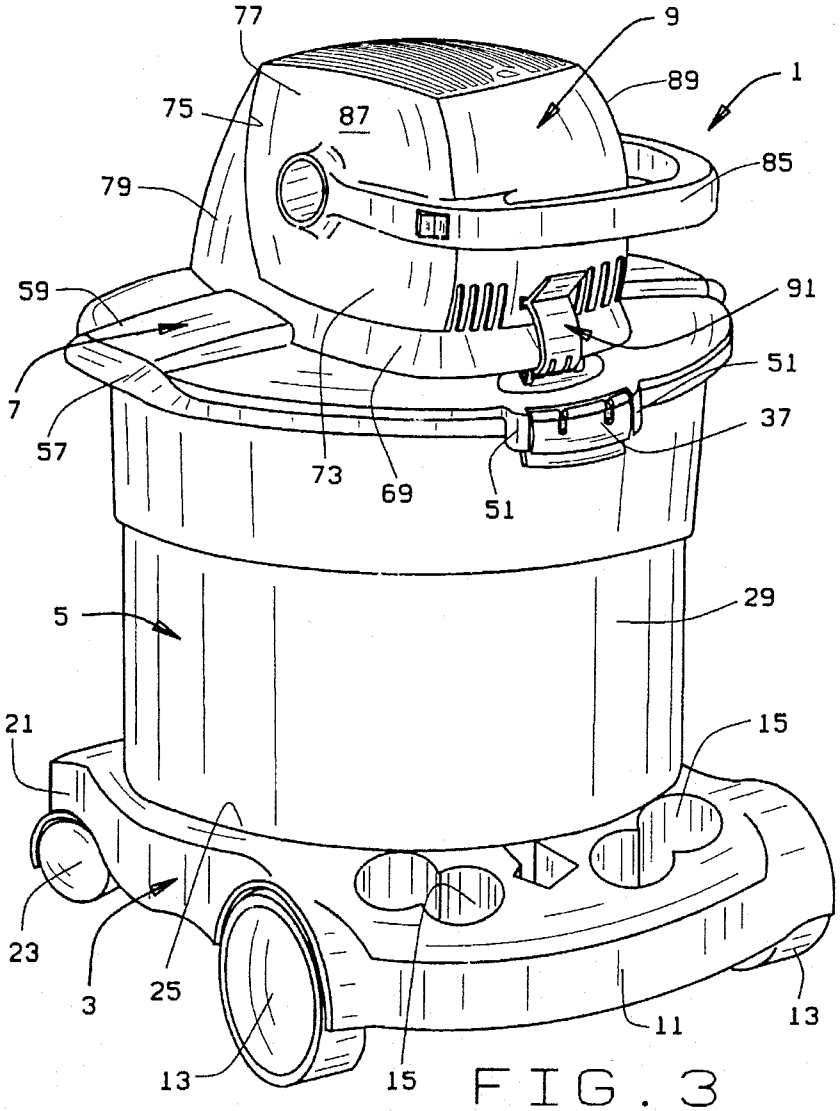
FIG. 3 is a rear perspective view of the wet/dry utility vacuum cleaner with detachable blower of the present invention.
Figure 6:
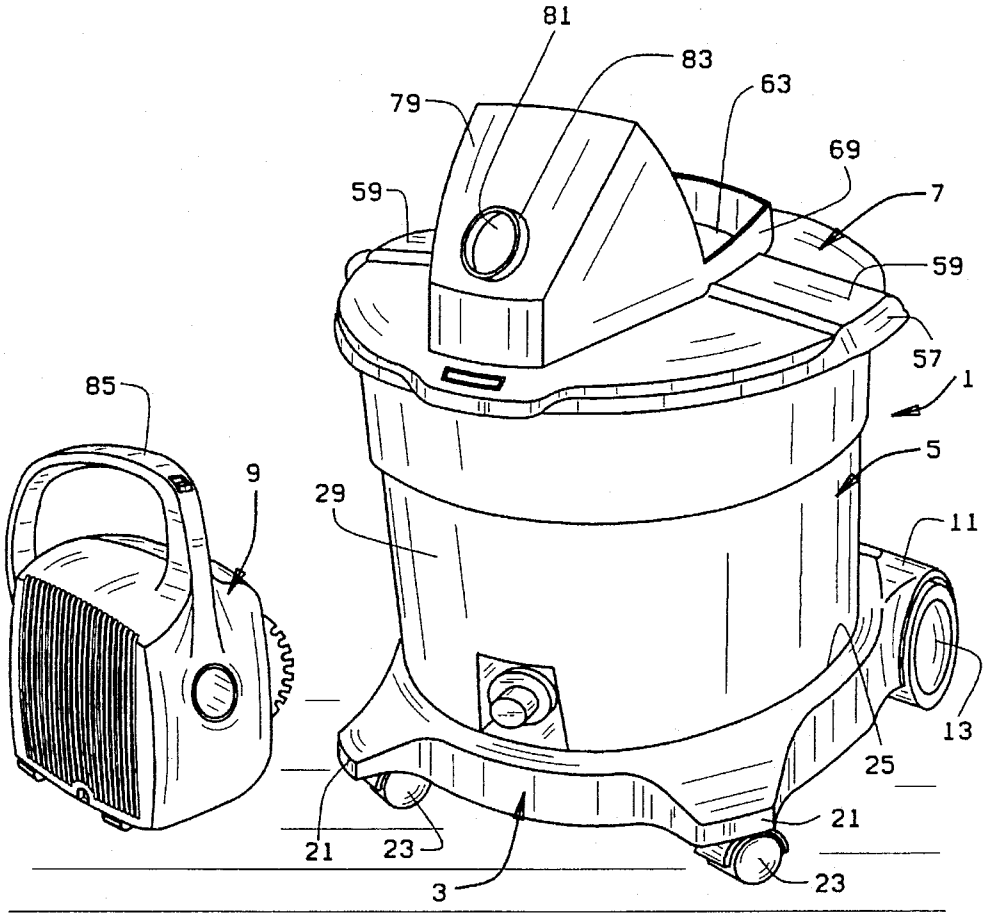
FIG. 6 is a right front perspective view of the wet/dry utility vacuum cleaner with detachable blower resting in an upright condition on a supporting surface.
Figure 5:
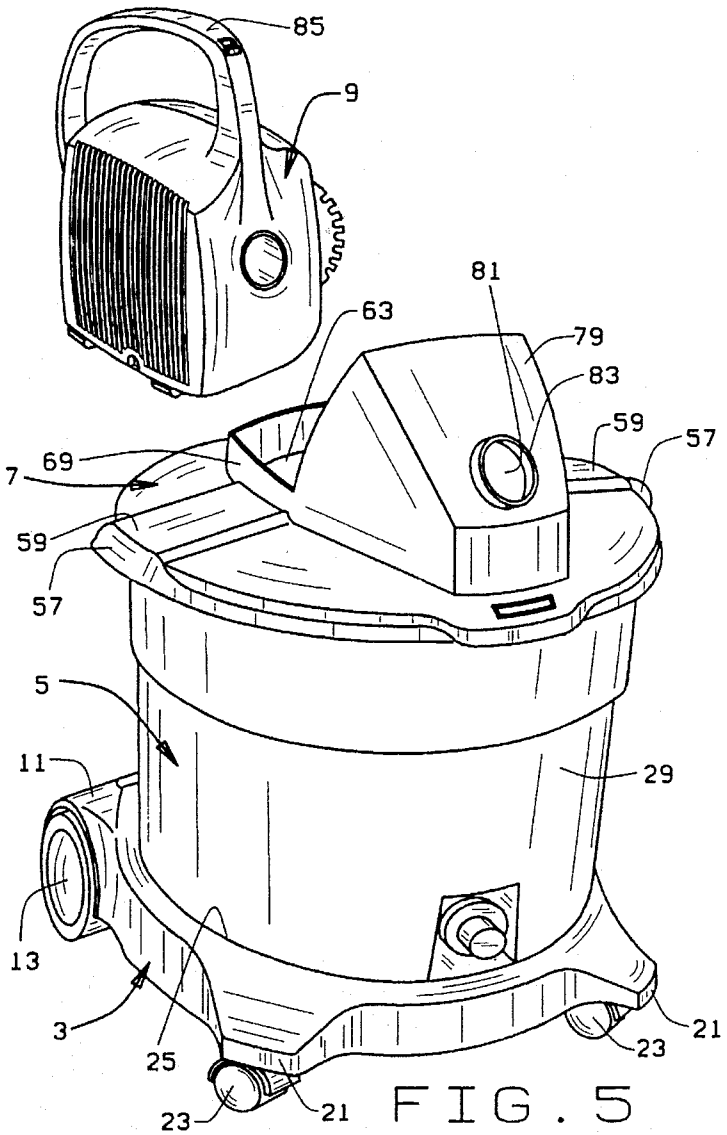
FIG. 5 is an exploded left front perspective view of the wet/dry utility vacuum cleaner with detachable blower removed therefrom for separate operation.

In addition to the lower wall cavity 63, the wall cavity 61 includes an upper wall cavity 75 for receiving the upper portion 77 of the detachable blower, as also illustrated in the assembled and disassembled positions of the detachable blower illustrated in FIGS. 3–4 of the drawings. The upper wall cavity 75 is formed by an extension of the outer wall 69 of the lower wall cavity that also extends upwardly to form an enclosed hood 79 that overlies part of the upper portion 77 of the detachable blower 9 when the detachable blower 9 is received within the upper wall cavity 75, as explained above. The hood 79 is complementary configured relative to the upper wall portion 77 of the detachable blower 9 and is also ornamentally shaped and configured to form the construction illustrated in FIGS. 1–8 and 11–12 of the drawings. The hood 79 includes a vacuum inlet 81 that communicates with the upper wall cavity 75 that opens up into the interior of the vacuum cleaner drum 5. The vacuum inlet 81 receives a vacuum hose in a friction fit assembled relationship along the inner wall of the collar 83 which defines the vacuum inlet 81. The manner in which the vacuum inlet 81 communicates with the interior drum 55 and the other operating components of the wet/dry utility vacuum cleaner with detachable blower 1 will be further explained in detail below.

As best seen in FIGS. 3–4 of the drawings, the detachable blower 9 is used jointly with the wet/dry utility vacuum cleaner 1 as shown in FIG. 3 or is used independently as blower for non-vacuuming applications, as illustrated in FIG. 4 of the drawings. For this purpose, a U-shaped handle is integrally molded to opposite spaced sides 87, 89 of the injection moled blower housing, as best seen in FIGS. 1–4 and 7–8 of the drawings. Thus, a suer can readily lift the detachable blower 9 through the U-shaped handle 85 from the wall cavity 61, including the lower wall cavity 63 and the upper wall cavity 75 of the lid 7. However, before this can be accomplished, the releasable blower latch 91, which is itself pivotally mounted to the lid 7, must be moved to a disengaged position relative the blower 9. In order to understand the operation of the releasable blower latch 91 relative to the blower 9, reference is made to FIGS. 7–12 and 20–22 of the drawings.

Figure 9:
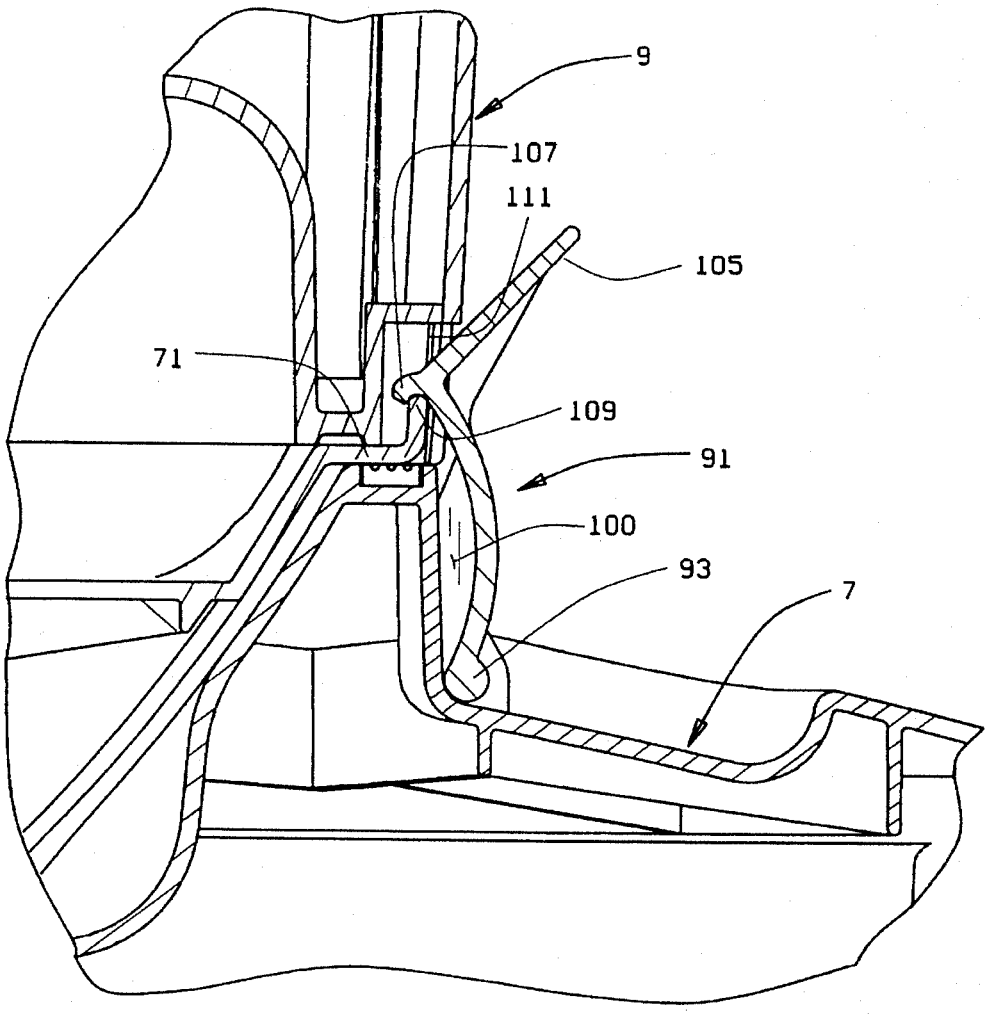
FIG. 9 is a fragmentary enlarged perspective view illustrating the manner in which the releasable blower latch is pivotally mounted to the lid that extends across the vacuum cleaner drum for detachable engagement relative to the detachable blower.
Figure 10:
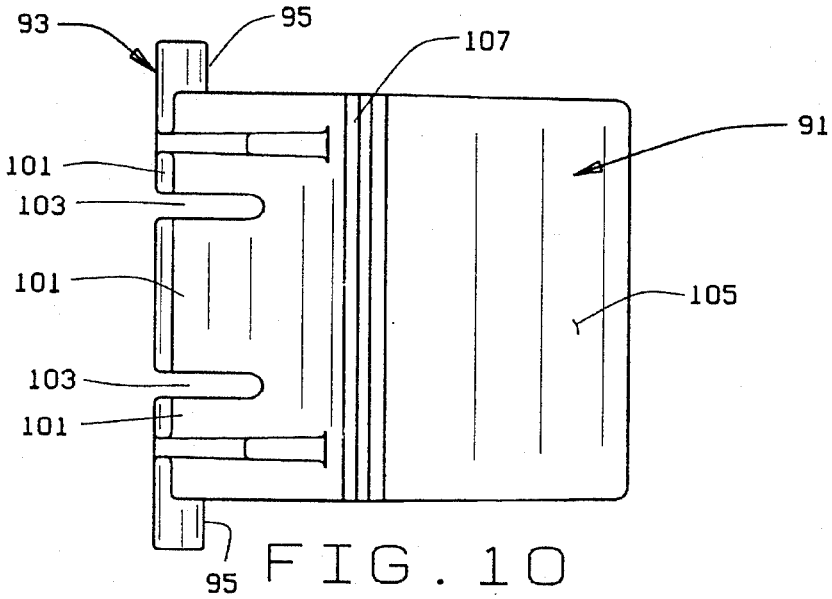
FIG. 10 is a top plan view of the releasable blower latch illustrated in FIGS. 7–9 of the drawings.
Figure 21:
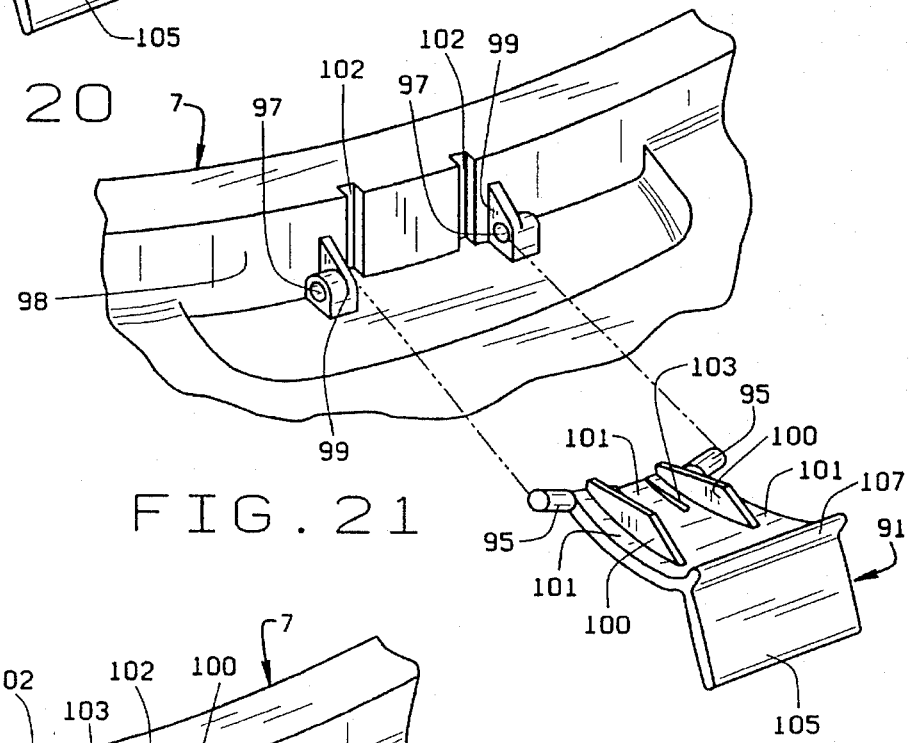
FIG. 21 is a fragmentary perspective view of the lid with the releasable blower latch being deformed for attachment to the lid.
Figure 22:
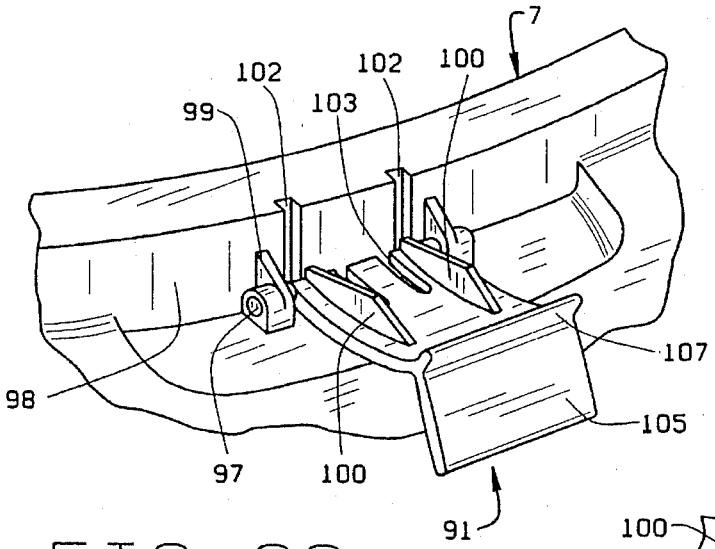
FIG. 22 is a fragmentary perspective view of the assembled lid and releasable blower latch in an unlatched position, as compared to the latched position shown in FIGS. 9 and 23.
Figure 23:
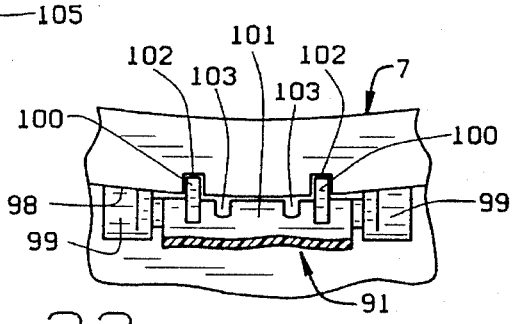
FIG. 23 is a fragmentary top plan view, partially in section to the releasable blower latch in engaged or latched position relative to the lid.

The releasable blower latch 91 is pivotally mounted at 93 to the lid 7, as shown in FIGS. 9–10, through the use of spaced and aligned posts 95, 95 that extend outwardly from the releasable blower latch 91 for reception within complementary shaped holes 97, 97 of the spaced integral support ears 99, 99 formed in the lid 7, as shown in FIGS. 11–12. Blower latch 91 includes, on its inner face, a pair of spaced apart, substantially rigid fins 100, 100. Like the releasable lid latch 37, the upper end of the releasable blower latch 91 includes, in alignment with the spaced posts 95, 95, a series of aligned and spaced sections 101, 101 separated by openings 103, 103, in order to allow the pivot posts 95, 95 to be resiliently deformed inwardly relative to the complementary shaped mounting holes 97, 97 provided in the spaced ears 99, 99, as best seen in FIG. 21. Once the spaced and aligned posts 95, 95 are received within the complementary shaped mounting holes 97, 97 of the spaced support ears 99, 99, the aligned and spaced sections 101, 101,101 are returned to their normal condition for securing releasable blower latch 91 in assembled position relative to the spaced support ears 99, 99 of the lid 7. The lid includes a pair of spaced apart openings 102, 102 that are formed in a vertical wall 98 between the spaced support ears 99, 99. Openings 102, 102 are formed in the vertical wall 98 of the lid 7 and positioned to be complementary to the fins 100, 100 of the blower latch 91. As seen in FIG. 22, fins 100, 1 00 do not interfere with slots 102, 102 in the lid 7 when the latch is in its lowered or unlatched position. Thus, the fins 100, 100 are seated in the openings 102, 102 when posts 95, 95 of the latch 91 are received in the spaced support ears 97, 97 of the lid 7 and latch 91 is pivoted to a latched position relative to the lid, as shown in FIG. 23. It will be appreciated that the seating of fins 100, 100 in openings 102, 102 also prevents deformation of latch 91 and thus prevents disengagement of posts 95, 95 from the spaced support ears 97, 97 of the lid 7. In this way, the blower latch 7 is also strengthened or reinforced when in assembled position to the lid 7.

At an opposite end from the spaced pivot posts 95, 95, the releasable blower latch 91 includes an upstanding finger engaging portion 105 for moving the releasable blower latch 91 into engagement or disengagement relative to the blower 9. For this purpose, the releasable blower latch 91 includes a flexible locking shoulder 107 that resiliently engages a lower locking shoulder 109 in a complementary latch opening 111 formed in the blower housing, as best illustrated in FIG. 9 of the drawings.

Figure 7:
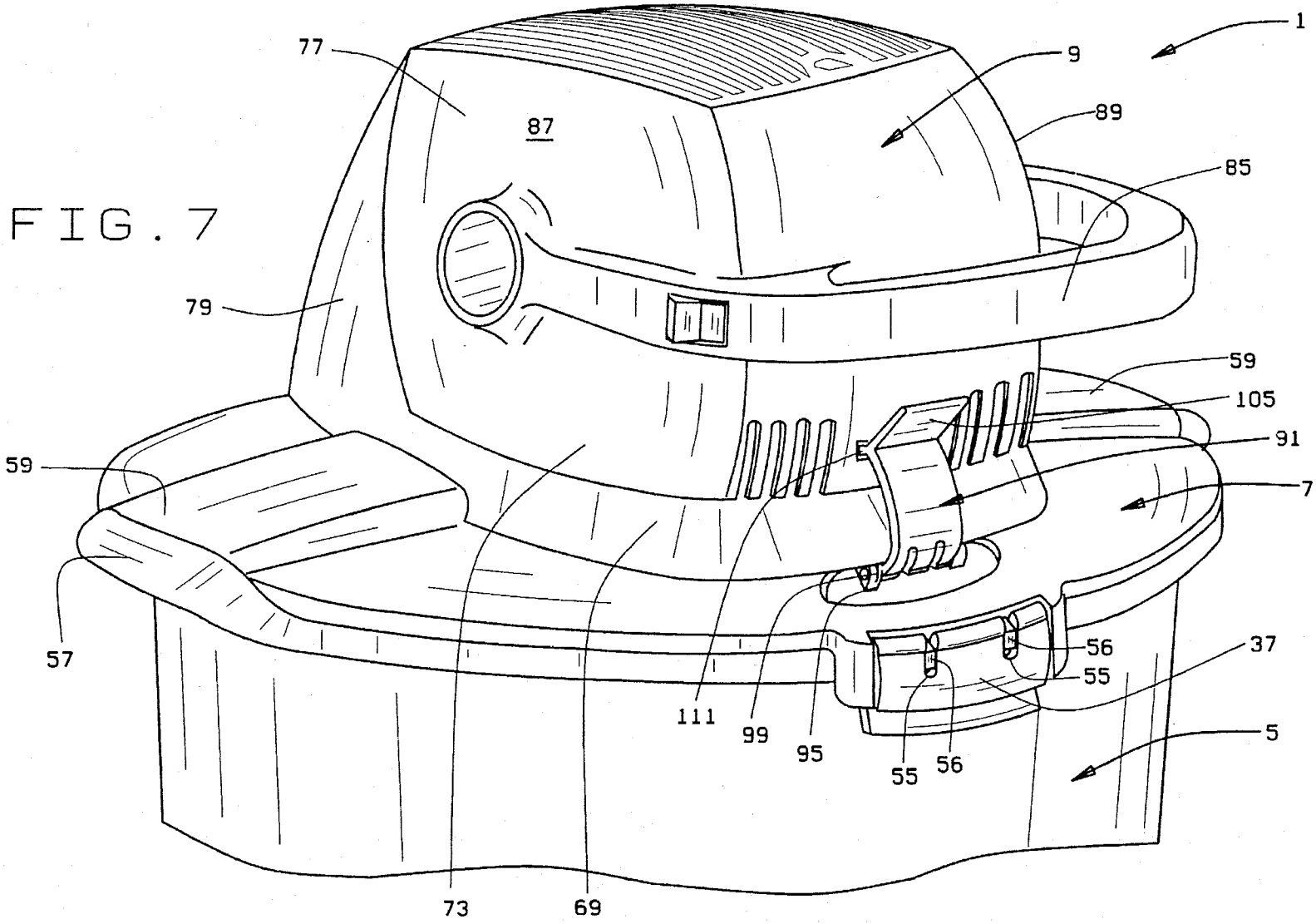
FIG. 7 is a fragmentary enlarged left rear perspective view of the detachable blower mounted and held in position by a releasable blower latch relative to a lid extending across the open upper end of a vacuum cleaner drum used with a wet/dry utility vacuum cleaner.
Figure 8:
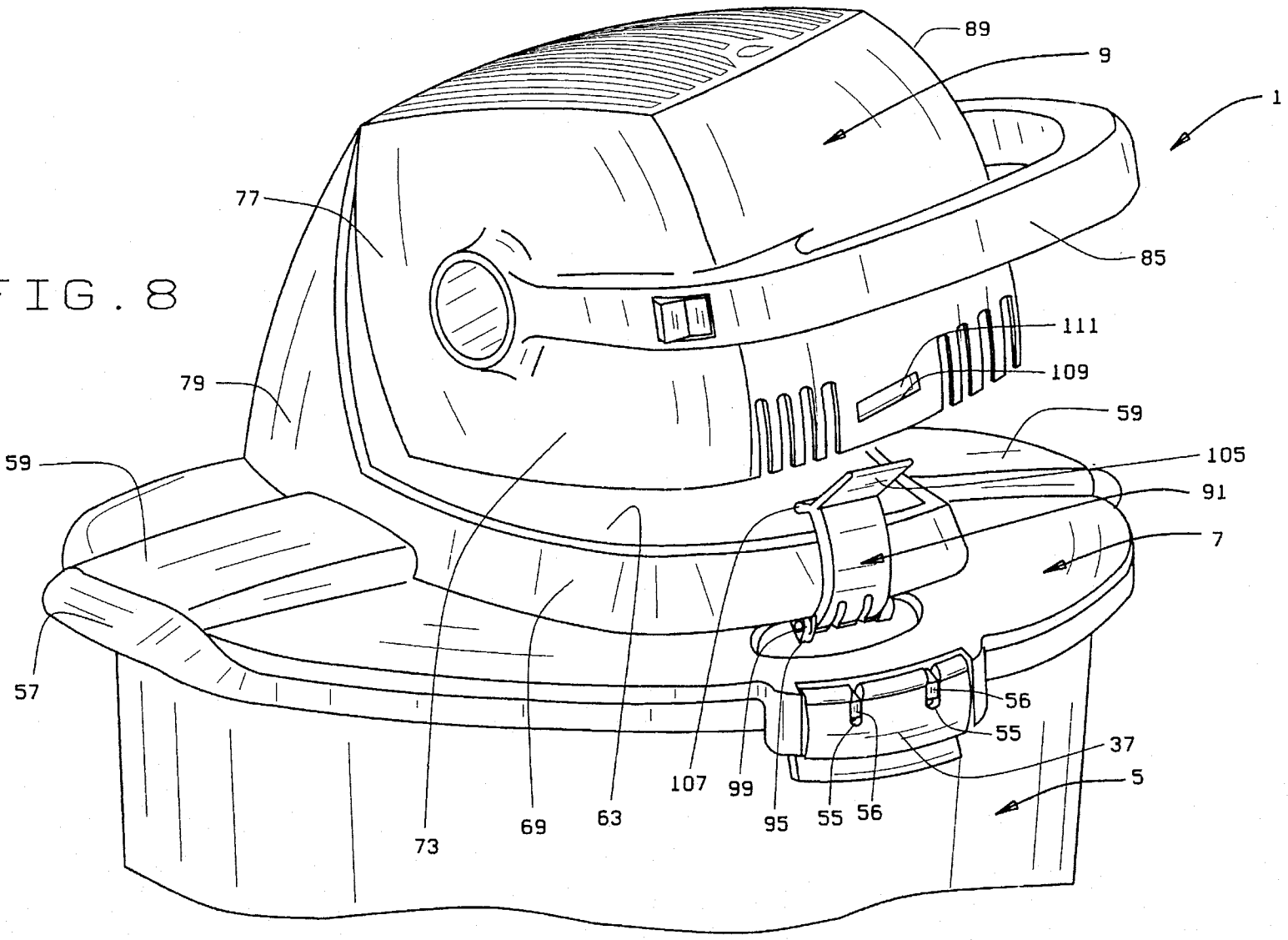
FIG. 8 is a fragmentary enlarged left rear perspective view of the detachable blower as it is removed from the lid that extends across the top of the vacuum cleaner drum, after the releasable blower latch has been disengaged from the detachable blower.

When the detachable blower is operated jointly with respect to the wet/dry utility vacuum cleaner 1, it assumes the position illustrated in FIG. 7 of the drawings where the lower portion 73 of the blower 9 is received within the outer shoulder 69 of the lower wall cavity 63, while the releasable blower latch 91 engages, through its locking shoulder 107, the lower locking shoulder 109 associated with the complementary latch opening 111. When it is desired to disassemble the detachable blower 9 from the wet/dry utility vacuum cleaner 1 as illustrated in FIG. 8 of the drawings, the upstanding finger engaging portion 105 of the releasable blower latch 91 is depressed to move the resilient locking shoulder 107 of the releasable blower latch 91 out of engagement with its complementary engaged lower shoulder 109 of the complementary latch opening 111. As will be understood in describing the operating components of the wet/dry utility vacuum cleaner 1 with detachable blower 9, the detachable blower 9 must be sealed relative to the lid 7 for the proper operation of the wet/dry utility vacuum cleaner 1. The releasable blower latch 91 assists in the proper sealed condition relative to the lid 7, as will also now be understood.

The U-shaped handle 85 and the releasable blower latch 91 are mounted in proximity to one another to enable a user to both grip the U-shaped handle 85 and with one finger engage or disengage the upstanding finger engaging portion 105 of the releasable blower latch 91 for the removal or replacement of the detachable blower 9 relative to the lid cavity 61 of the lid 7. There is thus provided a single one-handed positive engagement/release of the releasable blower latch 91 relative to the detachable blower 9 in order to enhance the ease and speed of removing the detachable blower 9 relative to the lid 7. The U-shaped handle 85 of the detachable blower 9 also provides one-handed release and pivot of the detachable blower 9 relative to the lid cavity 61 of the lid 7 in order to remove/install the detachable blower 9 relative to the wall cavity 6 1 of the lid 7.

From the foregoing, it will now be appreciated that the latching mechanism for the wet/dry utility vacuum cleaner with detachable blower will enable operation of such unit as a wet/dry utility vacuum cleaner when the detachable blower is mounted in the vacuum cleaner drum, while also enabling the detachable blower to be easily separated from the utility vacuum cleaner drum for separate non-vacuuming applications.

It will also be appreciated that the releasable blower latch and lid latch of the present invention also facilitate the operation and use of the wet/dry utility vacuum cleaner with detachable blower.

It will be appreciated by those skilled in the art that various changes and modification can be made. For example, the illustrated preferred embodiment employs a releasable lid latch having a pair of openings that allow for deformation and a pair of fins that seat in the openings, when the lid latch is engaged, in order to prevent deformation and disengagement. However, the lid latch could be constructed with only one opening which would engage a single corresponding fin. Further, two or more fins and corresponding openings could also be used. Similarly, the blower latch, shown as having two fins for engaging two openings on the lid to resist deformation could also be constructed with only one fin and corresponding opening or with more than two such fins and openings, if desired.

As various changes could be made in the above constructions without departing from the scope of the invention, it is intended that all matter contained in the above description or shown in the accompanying drawings shall be interpreted as illustrative and not in a limiting sense.

We claim:

1. A wet/dry utility vacuum cleaner including:

a vacuum cleaner drum having a bottom wall, a sidewall and an enlarged rim surrounding an open upper end;

a lid detachably mounted to the enlarged rim and extending across the open upper end of the vacuum cleaner drum;

a motor powered blower detachably mounted to said lid;

said lid including a releasable blower latch for releasably securing the blower to the lid and a releasable lid latch for releasably securing the lid to the drum;

said releasable blower latch and said releasable lid latch both being laterally deformable to facilitate engagement within complementary blower and lid latch supporting structure provided in said lid;

said releasable blower latch and said releasable lid latch when mounted in said complementary blower and lid latch supporting structure capable of being moved into a disengaged or engaged position relative to said blower and lid; and structural reinforcing means provided on each one of said releasable blower latch and releasable lid latch or said lid to restrict lateral deformation of said releasable blower latch and releasable lid latch when in engaged position relative to said blower and lid.

2. The wet/dry utility vacuum cleaner as defined in claim 1 in which the releasable blower latch and releasable lid latch include at least one opening to facilitate lateral deformation.

3. The wet/dry utility vacuum cleaner as defined in claim 2 in which the structural reinforcing means includes at least one reinforcing fin for reception within the at least one opening in said releasable blower latch and releasable lid latch when in engaged position relative to said lid.

4. A wet/dry utility vacuum cleaner including:

a vacuum cleaner drum having a bottom wall, a side wall and an enlarged rim surrounding an open upper end;

a lid detachably mounted to the enlarged rim and extending across the open upper end of the vacuum cleaner drum;

said lid including a resilient and deformable releasable blower latch for releasably securing a motor powered blower to said lid;

said releasable blower latch including a pair of opposed pivot posts at one end for engaging complementary openings provided in spaced latch supports in said lid;

said releasable blower latch being laterally deformable between said pivot posts to permit deformation of said pivot posts for entry between said spaced latch supports and subsequent resilient return to its original shape when aligned with said complementary openings for reception of said pivot posts; and structural reinforcing means provided in one of said releasable blower latch or lid to restrict lateral deformation of said releasable blower latch when releasably securing the motor powered blower to said lid.

5. A wet/dry utility vacuum cleaner including:

a vacuum cleaner drum having a bottom wall, a sidewall and an enlarged rim surrounding an open upper end;

a lid detachably mounted to the enlarged rim and extending across the open upper end of the vacuum cleaner drum;

said lid including a resilient and deformable releasable lid latch for releasably securing said lid to the enlarged rim of the drum;

said releasable lid latch including a pair of opposed pivot posts at one end for engaging complementary openings provided in spaced latch supports in said lid;

said releasable lid latch being laterally deformable between said pivot posts to permit deformation of said pivot posts for entry between said spaced latch supports and subsequent resilient return to its original shape when aligned with said complementary openings for reception of said pivot posts; and structural reinforcing means provided in one of said releasable lid latch or lid to restrict lateral deformation of said releasable lid latch when releasably securing the lid to said drum.

6. A wet/dry utility vacuum cleaner including:

a vacuum cleaner drum having a bottom wall, a side wall and an enlarged rim surrounding an open upper end;

a lid detachably mounted to the enlarged rim and extending across the open upper end of the vacuum cleaner drum;

a motor powered blower associated with said lid;

said lid including a blower latch for releasably securing said blower to said lid, said latch being resilient and deformable for engagement with a latch mounting structure in said lid; and at least one reinforcing fin in one of said latch and lid that is disposed for engagement within a complementary opening of the other of said latch and lid in order to prevent deformation and disengagement of said latch from said latch mounting structure.

7. The wet/dry utility vacuum cleaner as defined in claim 6 in which said at least one fin is integrally formed on said latch.

8. The wet/dry utility vacuum cleaner as defined in claim 7 in which said at least one complementary opening is formed in said lid for receiving said at least one fin when said latch is in latched position.

9. A wet/dry utility vacuum cleaner including:

a vacuum cleaner drum having a bottom wall, a sidewall and an enlarged rim surrounding an open upper end;

a lid detachably mounted to the enlarged rim and extending across the open upper end of the vacuum cleaner drum;

said lid including a lid latch for releasably attaching said lid to said drum, said lid latch being resilient and deformable for engagement with a latch mounting structure in said lid; and at least one reinforcing fin in one of said lid latch and lid that is disposed for engagement within a complementary opening of the other of said lid latch and lid in order to prevent deformation and disengagement of said lid latch from said latch mounting structure.

10. The wet/dry utility vacuum cleaner as defined in claim 9 in which said at least one fin is integrally formed on said lid.

11. The wet/dry utility vacuum cleaner as defined in claim 10 in which said at least one complementary opening is formed in said lid latch for receiving said at least one fin when said lid latch is in latched position.

12. In a wet/dry vacuum cleaner, a blower latch for releasably securing a detachable blower to a lid mounted over a vacuum cleaner drum, the blower latch comprising:

a resilient and deformable element including a locking shoulder for releasably securing the detachable blower to the lid;

a pair of opposed laterally outwardly directed pivot posts at one end of the blower latch;

at least one deformable opening in said blower latch between said pivot posts to enable lateral deformation of said pivot posts for passage between spaced supports in said lid;

said spaced supports including opposed pivot post openings for reception and resilient return of said pivot posts into pivotal engagement with said spaced supports; and at least one reinforcing fin provided in one of said blower latch or lid for engaging a complementary opening in the other of said blower latch or lid to restrict lateral deformation of the blower latch when the locking shoulder of the blower latch releasably secures the detachable blower to the lid.

13. The improvement as defined in claim 12 in which the at least one reinforcing fin is provided in the blower latch for engaging a complementary opening in said lid when the locking shoulder of the blower latch releasably secures the detachable blower to the lid.

14. The improvement as defined in claim 13 including spaced reinforcing fins provided in the blower latch for engaging spaced complementary openings in said lid.

15. In a wet/dry vacuum cleaner, a lid latch for releasably securing a lid over a vacuum cleaner drum, the lid latch comprising:

a resilient and deformable element including a locking shoulder for releasably securing the lid to the drum;

a pair of opposed laterally outwardly directed pivot posts at one end of the lid latch;

at least one deformable opening in said lid latch between said pivot posts to enable lateral deformation of said pivot posts for passage between spaced supports in said lid;

said spaced supports including opposed pivot post openings for reception and resilient return of said pivot posts into pivotal engagement with said spaced supports; and at least one reinforcing fin provided in one of said lid latch or lid for engaging a complementary opening in the other of said lid latch or lid to restrict lateral deformation of the lid latch when the locking shoulder of the lid latch releasably secures the lid to the drum.

16. The improvement as defined in claim 14 in which the at least one reinforcing fin is provided in the lid for reception within the deformable opening of the lid latch when the locking shoulder releasably secures the lid latch to the lid.

17. The improvement as defined in claim 16 including spaced reinforcing fins provided in the lid for engaging spaced complementary deformable openings in said lid latch between said pivot posts.

18. A wet/dry utility vacuum cleaner, including:

a lid for mounting over the enlarged rim at an open upper end of the wet/dry utility vacuum cleaner, said lid having a downwardly extending hooked shaped pivot element for pivotal engagement with the enlarged rim, said hook shaped pivot element being mounted beneath the enlarged rim when the lid is positioned at an angle to said enlarged rim to enable a limited range of pivotal movement of said lid relative to said container from said aforementioned angle to a transverse position of said lid when mounted in closed position over the open upper end of said container, said lid further having a releasable lid latch formed in said lid at a location generally opposite said hooked shaped pivot element, said releasable lid latch having an upper end and a lower end, said releasable lid latch being pivotally mounted to the lid at its upper end and having a finger gripping section adjacent to and including its lower end, and said releasable lid latch further having a releasable locking element positioned intermediate the upper and lower ends hereof which is configured, arranged and dimensioned for releasable locking engagement beneath the enlarged rim of the container, said releasable lid latch being pivotally moved between a disengaged position away from said enlarged rim to an engaged position beneath said enlarged rim.

19. The wet/dry utility vacuum cleaner as defined in claim 18 wherein the releasable locking element is resilient and deflectable for camming locking engagement with said enlarged rim.

20. The wet/dry utility vacuum cleaner as defined in claim 19 wherein the upper end of said releasable lid latch includes aligned and spaced pivot posts extending laterally outwardly from said releasable drum latch for pivotal mounting to spaced supports extending radially outwardly from said lid.

21. The wet/dry utility vacuum cleaner as defined in claim 20 wherein the upper end of said releasable lid latch between said aligned and spaced pivot posts is resilient and deformable in order to enable said aligned and spaced pivot posts to be moved inwardly prior to being received within complementary shaped mounting holes of the spaced supports.

22. The wet/dry utility vacuum cleaner as defined in claim 21 wherein the upper end of the releasable lid latch includes a series of aligned and spaced sections for resilient and deformable operation of said pivot posts relative to the complementary shaped mounting holes of the spaced supports.

23. The wet/dry utility vacuum cleaner as defined in claim 18 wherein the detachable blower is releasably mounted to said lid by a releasable blower latch that is pivotally mounted to the lid for engagement with said blower.

* * * * *